US009674602B2

(12) United States Patent
Clark

(10) Patent No.: US 9,674,602 B2
(45) Date of Patent: Jun. 6, 2017

(54) ACOUSTIC ELEMENT FOR A SPEAKER

(71) Applicant: Bose Corporation, Framingham, MA (US)

(72) Inventor: Andrew W. Clark, Shrewsbury, MA (US)

(73) Assignee: Bose Corporation, Framingham, MA (US)

( * ) Notice: Subject to any disclaimer, the term of this patent is extended or adjusted under 35 U.S.C. 154(b) by 252 days.

(21) Appl. No.: 14/256,518

(22) Filed: Apr. 18, 2014

(65) Prior Publication Data

US 2015/0304746 A1 Oct. 22, 2015

(51) Int. Cl.

*H04R 1/02* (2006.01)
*H04R 1/28* (2006.01)
*H04R 31/00* (2006.01)

(52) U.S. Cl.

CPC ..... *H04R 1/2842* (2013.01); *H04R 1/025* (2013.01); *H04R 1/2834* (2013.01); *H04R 31/003* (2013.01); *H04R 2201/021* (2013.01); *H04R 2201/025* (2013.01)

(58) Field of Classification Search

CPC . H04R 1/02; H04R 1/025; H04R 1/28; H04R 1/2834; H04R 1/2873; H04R 7/18; H04R 7/26; H04R 31/003; H04R 2231/003; H04R 31/006; H04R 2201/025; H04R 2201/029; H04R 1/2819; H04R 1/2842; H04R 9/043; H04R 2201/021

USPC ..... 381/304, 305, 89, 332, 335, 345, 349, 381/182, 186, 386; 181/144, 155, 156, 181/199; 29/594, 609.1

See application file for complete search history.

(56) References Cited

U.S. PATENT DOCUMENTS

| | | | | |
|---|---|---|---|---|
| 3,780,824 | A * | 12/1973 | Prince | H04R 1/2834 181/144 |
| 7,133,533 | B2 | 11/2006 | Chick et al. | |
| 7,568,522 | B2 | 8/2009 | Boutwell et al. | |
| 8,189,841 | B2 | 5/2012 | Litovsky et al. | |
| 8,240,426 | B2 | 8/2012 | Silver et al. | |
| 8,638,975 | B2 | 1/2014 | Jeffery | |
| 2007/0092096 | A1 | 4/2007 | Litovsky | |
| 2010/0111343 | A1* | 5/2010 | Hsu | H04R 1/2834 381/335 |
| 2013/0213628 | A1 | 8/2013 | Litovsky et al. | |
| 2014/0029782 | A1* | 1/2014 | Rayner | H04R 1/2834 381/386 |
| 2014/0064539 | A1 | 3/2014 | Link et al. | |
| 2014/0369546 | A1* | 12/2014 | Huang | H04R 1/2834 381/395 |
| 2015/0156572 | A1* | 6/2015 | Li | H04R 1/28 381/386 |

FOREIGN PATENT DOCUMENTS

WO 2013169694 A2 11/2013

* cited by examiner

*Primary Examiner* — Huyen D Le

(57) ABSTRACT

A speaker includes an electroacoustic driver, a first wall that includes an integral suspension element, and a mass suspended by the suspension element to form a passive radiator. Acoustic energy from the electroacoustic driver can cause the passive radiator to move.

6 Claims, 4 Drawing Sheets

ACOUSTIC ELEMENT FOR A SPEAKER

This disclosure relates to a speaker. International patent application PCT/US2013/039815 discloses a deployable speaker that includes a driver and an acoustic enclosure made up of a multiplicity of panels. The driver is secured to one of the panels. The acoustic enclosure is deployable from a closed state to a deployed state. When one of the panels is moved by a user from the closed to the deployed state, all but one of the remaining panels are simultaneously moved from the closed to the deployed state.

BACKGROUND

It is desirable to make the deployable speaker as compact as possible when it is in the closed state. One way to achieve this goal is to have any passive radiator included in the speaker be thin in a direction perpendicular to a plane in which the passive radiator lies. Existing passive radiators incorporate heterogeneous surrounds that restrict how compact a deployable speaker can be when the speaker is in a closed state.

SUMMARY

All examples and features mentioned below can be combined in any technically possible way.

In one aspect, a speaker includes an electroacoustic driver, a first wall that includes an integral suspension element, and a mass suspended by the suspension element to form a passive radiator. Acoustic energy from the electroacoustic driver can cause the passive radiator to move.

Embodiments may include one of the following features, or any combination thereof. The suspension element can have a cross-section that is substantially different from another portion of the wall. The wall is an external wall of the speaker. The suspension element includes one or more of polypropylene and polyethylene. The wall has a skin of metal covering at least part of the wall. The suspension element is formed by removing portions of the wall. The speaker further includes a second wall to which the electroacoustic driver is secured.

In another aspect, an acoustic element for a speaker includes a wall of the speaker that includes an integral suspension element and one or more of a mass and at least a portion of an electroacoustic driver that are suspended by the suspension element.

Embodiments may include one of the above and/or below features, or any combination thereof. The acoustical element includes the mass and not the electroacoustic driver such that the suspension element and mass form a passive radiator. The wall has a skin of aluminum covering at least part of the wall. The wall is substantially flat.

In another aspect, a method of forming an acoustic element for a speaker includes providing a wall of the speaker that includes an integral suspension element. One or more of a mass and at least a portion of an electroacoustic driver are secured to the suspension element.

In another aspect, an acoustic element for a speaker includes a support element of the speaker that includes an integral suspension element and one or more of a mass and at least a portion of an electroacoustic driver that are suspended by the suspension element. The support element is secured to at least one of a wall of the speaker and another element of the speaker.

DETAILED DESCRIPTION

The disclosure below describes a speaker that includes an electroacoustic driver. A first wall of the speaker includes a suspension element and a mass suspended by the suspension element to form a passive radiator. Acoustic energy from the electroacoustic driver can cause the passive radiator to move. By making the suspension element integral with the wall, the passive radiator can be made relatively thin perpendicular to a plane in which the passive radiator lies. Having a thin passive radiator allows a deployable speaker to be folded more compactly when the speaker is in a closed configuration.

Figure 1:
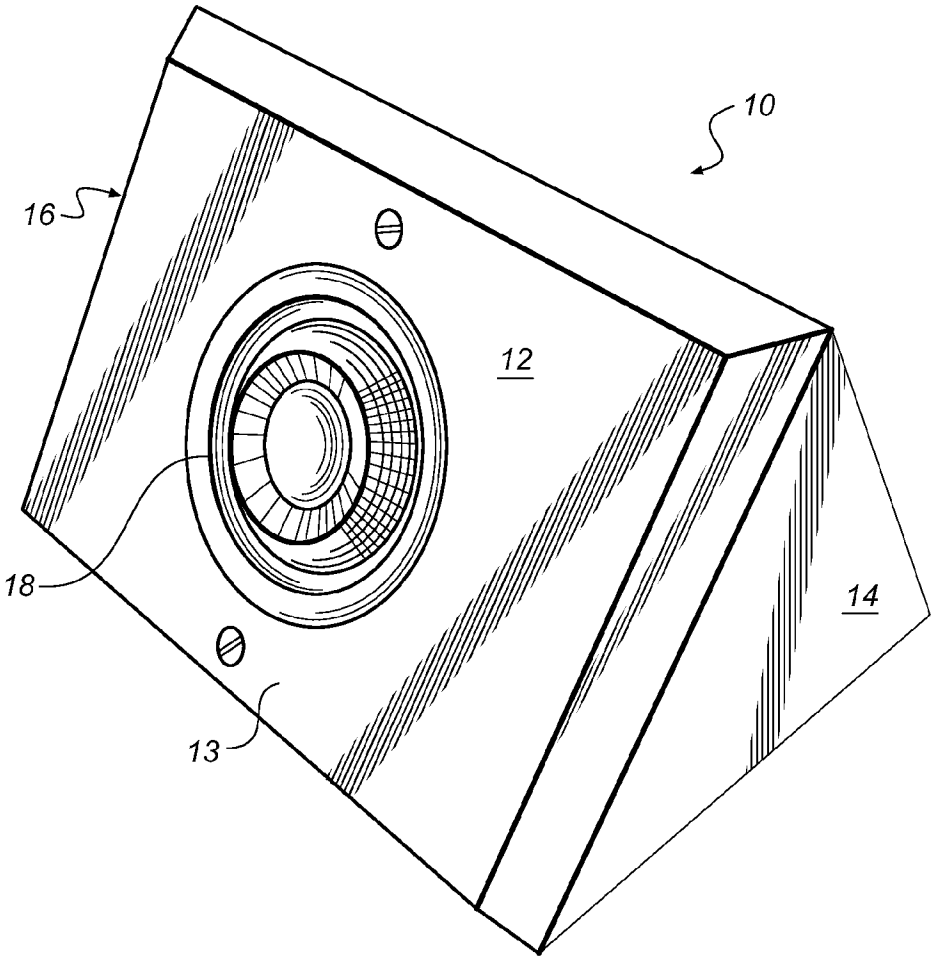
FIG. 1 is a perspective view of the folding portable speaker (FPS) in a deployed (open) configuration.

Referring to FIG. 1, the FPS 10 is shown in a deployed (open) configuration. Surfaces of the FPS (e.g. 12, 14) are joined to form a functional acoustic enclosure (i.e. substantially air tight) 16 which enables an electroacoustic driver 18 to reproduce the desired low-frequency audio content. A typical enclosure shape might be a rectangle 5"×7" on the front (12), rear and bottom, 5" equilateral triangle on the ends (including surface 14), and have a volume around 75 ci. The enclosure performance may be enhanced by the use of one or more passive radiators (described below). Further details of the FPS 10 can be found in the patent application identified in paragraph 1 above which is incorporated herein by reference.

Figure 2:
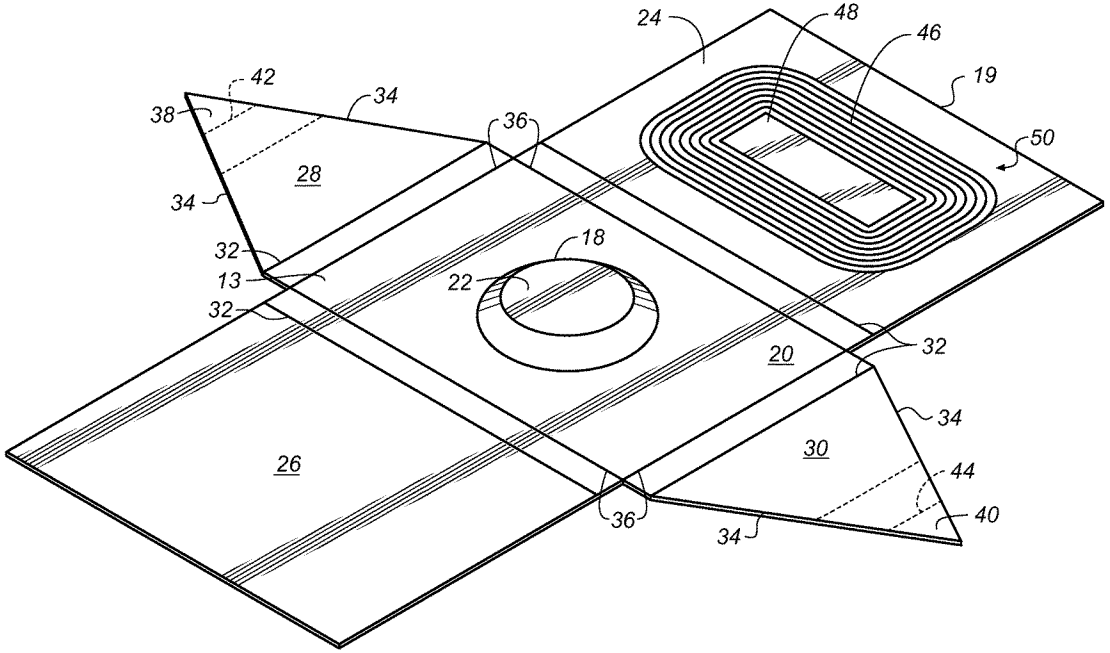
FIG. 2 is a perspective view of a composite sheet used in fabrication of the FPS.

Turning to FIG. 2, in its preferred embodiment, the enclosure 16 is to be cut out and fabricated from a single flat sheet of composite material 19. This composite material may be fabricated by laminating thin aluminum sheet onto both sides of a polypropylene or polyethylene core. The presently-identified sample composite product, brand name Hylite, is manufactured by 3A Composites Gmbh of Germany. This material has a total thickness of 2 mm (79 mils), and is composed of a polypropylene core of thickness=1.6 mm (63 mils) bonded on each side to an aluminum skin of thickness=0.2 mm (8 mils). Polypropylene is chosen because it has the best material characteristics for in-situ fabrication of reliable living hinges. Polyethylene has also been used for living hinge fabrication.

The electroacoustic driver 18 is mounted (i.e. secured) into a face (or wall) 20 of the composite enclosure 16. In one implementation, the speaker cone/surround/voice-coil assembly of the driver 18 is glued directly into a large (3") round hole in the front baffle surface 12. The rear assembly at location 22 (magnet structure not shown) is fastened to the rear face 20 of the baffle 13 at locations adjacent to the perimeter of the baffle hole, and is positioned precisely relative to the voice coil. Optional high-frequency stereo and/or surround speakers (not shown) may also be mounted into the baffle 13 or into a different surface of the enclosure 16. The other surfaces (faces or walls) 24 (rear), 26 (base), 28 (left end) and 30 (right end) of the composite enclosure 16 are connected to the low-frequency driver surface 12 by hinge means 32, which are preferentially living hinges formed within the composite material during sheet fabrication (described further below). Note in this example that the lines 36 denote permanent bends rather than hinges. The walls are substantially flat in this example.

Many sheet-metal fabrication methods can be used to form this material. The edges 34 can be profiled to present a poly-only butt contact to adjacent walls 24 and 26. Grooves machined into one side can be used to form inside- or outside-bends with different profiles (inside grooves along lines 36). Most uniquely, living hinges 32 can be fabricated within this material by machining matching grooves into both sides, leaving typically 16-18 mils poly thickness at the hinge axis.

The peripheral edges of the baffle 13 (front panel containing the driver 18) are bent along lines 36 to create the proper internal depth for the driver 18, and to position the hinged rear panel 24, base 26 and end panels 28 and 30 to fold over each other. The end panels (or walls) 28 and 30 fold in first, followed by the top 24 and then the base 26. The hinge positions are designed to allow the panels to fold flat, e.g. the end panel hinges are closest to the baffle face, followed by the top hinge and then the base hinge. Outer tips 38 and 40 of the end panels 28 and 30 may be specially chamfered so that both left and right ends can overlay for minimum total thickness.

Figure 3:
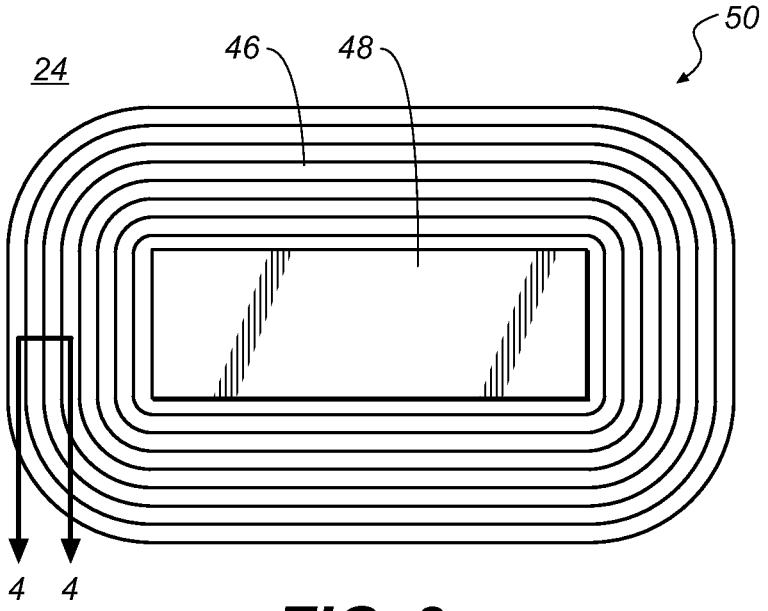
FIG. 3 is a top view of a wall of a speaker which includes an integral suspension element and a mass.

Referring to FIGS. 2 and 3, the wall 24 includes an integral (i.e. unitary) suspension element 46 (to be described in further detail below). A mass 48 is secured to the wall 24 inside the suspension element 46 such that the mass is suspended by the suspension element to form a passive radiator 50. The mass 48 can be, for example, a thin plate made of metal which fits into a routed cavity in a center area of the wall 24 and is attached to the wall with, for example, an adhesive. The weight of the mass 48 and the design of the suspension element 46 can be selected to tune the passive radiator. When the FPS 10 is in the deployed configuration (FIG. 1), acoustic energy from the electroacoustic driver 18 can cause the passive radiator 50 to move (e.g. vibrate). Even though FIG. 3 shows a rectangular shaped suspension element 46, the element 46 can be formed in other shapes (e.g. triangular, polygonal, round or irregular shaped).

Figure 4:
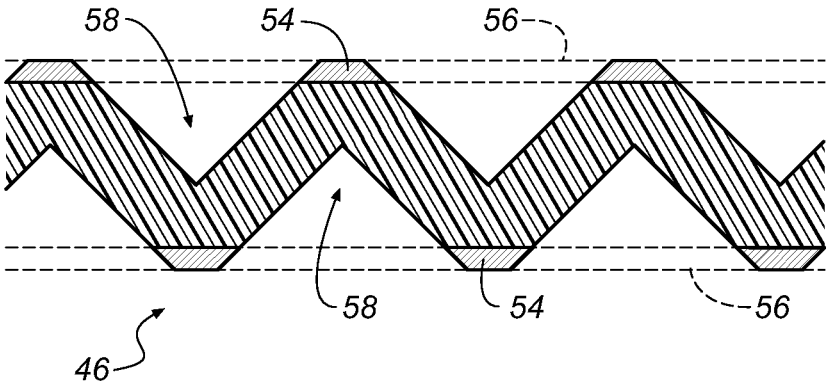
FIG. 4 is a cross-sectional view of a portion of the suspension element of FIG. 3 taken along the lines 4-4.

Turning to FIG. 4, a more detailed view of the suspension element 46 is disclosed. The suspension element is created in a similar way as the living hinge 32 (see above). That is, the suspension element 46 is in-situ fabricated (carved into) the wall 24 by machining away (removing) portions of the aluminum and polypropylene layers of the wall. The aluminum layers may be etched to remove the desired portions of these layers. This can result in a zig-zag (or V-cut) profiled polypropylene layer 52 which is capped at its apexes by the remaining aluminum layer 54. The polypropylene that is removed results in slots 58 which are positioned such that they are offset from each other on opposite sides of the wall 24. As such, the suspension element has a cross-section that is substantially different from other portions of the wall 24. In an alternative example there are no aluminum layers included in the suspension element 46.

The dashed lines 56 show where aluminum used to reside prior to the machining process. As described above, each aluminum layer might typically have a thickness of about 0.2 mm and the polypropylene layer might typically have a thickness of about 1.6 mm. This results in a total wall thickness of about 2.0 mm. The result is that the thickness of the wall 24 is substantially the same as the thickness of the passive radiator when the latter is not moving (i.e. the passive radiator is substantially co-planar with the wall 24). Note that the cross-section shows a V-cut profile, but round and other custom profile cuts could be used to fine-tune acoustic performance. The suspension element 46 can be machined into other shapes (e.g. with rounded apexes) to assist in achieving a desired tuning of the speaker (note that the tuning is largely determined by the mechanical compliance of the suspension element 46).

Figure 5:
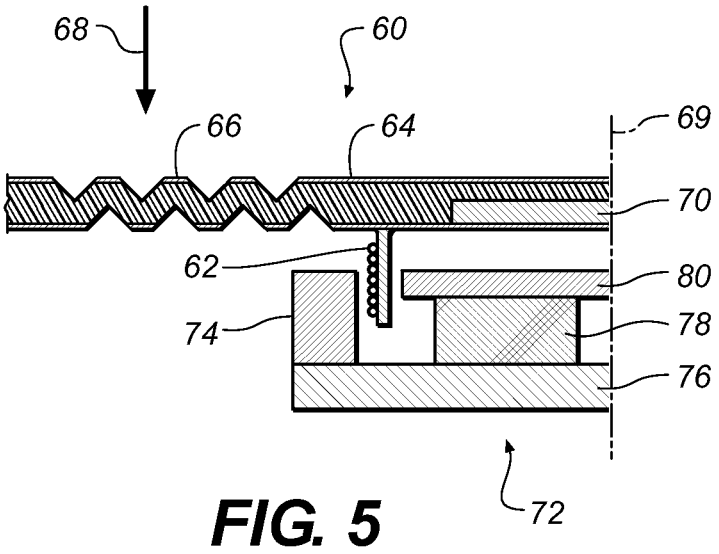
FIG. 5 is a partial sectional view of an electroacoustic driver with an integral suspension element.

In another example shown in FIG. 5, at least a portion of an electroacoustic driver 60 such as a voice coil/former 62 is attached to a wall or support element 64 inside a suspension element 66. This can be done in addition to or in place of a mass insert 70. The suspension element 66 is similar to the suspension element 46 shown in FIGS. 3 and 4 except that element 66 has a circular shape when viewed in a direction 68 whereas the element 46 has a racetrack shape (see FIG. 3). The circular shaped suspension element has a central axis 69. A magnetic assembly 72 includes a steel outer ring pole piece 74, a steel backplate 76, a neodymium ring magnet 78, and a steel inner pole piece 80. The voice coil 62 interacts electromagnetically with the magnetic assembly 72 which is attached to another portion of the speaker (not shown). As such, the suspension element 66 is being operated in a similar manner to a speaker surround. This results in an active acoustic radiator (speaker transducer) which has a relatively thin profile. An alternative to this arrangement is to swap the voice coil 62 and the magnet 78/pole piece 80 such that the coil is supported from the backplate 76 and the magnet 78/pole piece 80 is supported from the wall 64.

Figure 6:
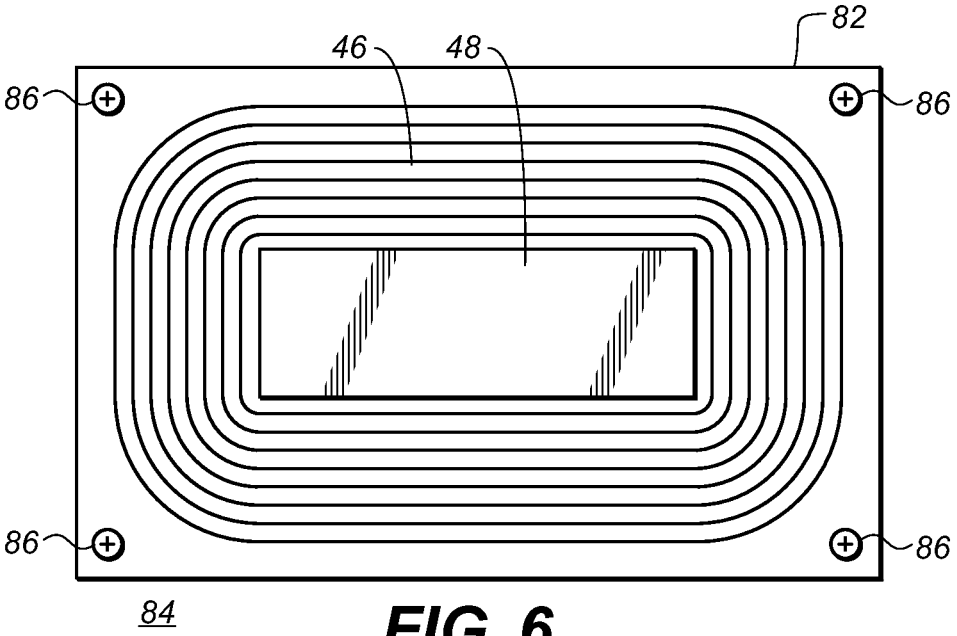
FIG. 6 is another example of a top view of a wall of a speaker which includes a suspension element and a mass.

Turning to FIG. 6, another example is shown which is similar to the example shown in FIGS. 3 and 4. Here, however, the suspension element 46 is integral with a support element 82 which in turn is secured to a wall 84 (or some other element) of a speaker with fasteners (e.g. screws) 86. The wall 84 can be made of all plastic material whereas the support element 82 and suspension element 46 are made of the same composite material as described above with respect to the example shown in FIGS. 3 and 4.

A number of implementations have been described. Nevertheless, it will be understood that additional modifications may be made without departing from the sprit and scope of the inventive concepts described herein, and, accordingly, other embodiments are within the scope of the following claims. For example, although the inventive concepts are described above in terms of a deployable speaker, these concepts are just as applicable to a more conventional speaker which is fixed in a deployed state and cannot be reconfigured to a closed state. In addition, although the suspension element is shown as part of an external wall of a speaker, this element could be part of an internal wall or some other internal portion of a speaker. Further, the suspension element described above could be arranged so that it is performing the function of a spider in a more traditional electroacoustic driver.

What is claimed is:

1. A speaker, comprising:

an electroacoustic driver;

a first wall that includes an integral suspension element; and a mass suspended by the suspension element to form a passive radiator, whereby acoustic energy from the electroacoustic driver can cause the passive radiator to move, wherein the suspension element is formed by removing portions of the wall.

2. The speaker of claim 1, wherein the suspension element has a cross-section that is substantially different from another portion of the wall.

3. The speaker of claim 1, wherein the wall is an external wall of the speaker.

4. The speaker of claim 1, wherein the suspension element includes one or more of polypropylene and polyethylene.

5. The speaker of claim 1, wherein the wall has a skin of metal covering at least part of the wall.

6. The speaker of claim 1, further including a second wall to which the electroacoustic driver is secured.

* * * * *